US005528884A

United States Patent [19]

Johnson

[11] Patent Number: 5,528,884

[45] Date of Patent: Jun. 25, 1996

[54] HORSE BIT ASSEMBLY INCLUDING AN ANGLED, CONFIGURED MOUTHPIECE AND CHEEKPLATES

[76] Inventor: Donald R. Johnson, R.F.D. 1, Box 200, Plymouth, N.H. 03264

[21] Appl. No.: 62,387

[22] Filed: May 14, 1993

[51] Int. Cl.[6] ..... B68B 1/06

[52] U.S. Cl. ..... 54/8

[58] Field of Search ..... 54/6.1, 7, 8, 9

[56] References Cited

U.S. PATENT DOCUMENTS

| | | | |
|---|---|---|---|
| 248,181 | 10/1881 | Jones | 54/8 |
| 466,485 | 1/1892 | Brockington | 54/8 |
| 481,172 | 8/1892 | Heinze | 54/7 |
| 511,811 | 1/1894 | Smith et al. | 54/8 |
| 952,610 | 3/1910 | Daly et al. | 54/7 |
| 1,875,195 | 8/1932 | Megargee | 54/8 |
| 2,012,705 | 8/1935 | Bergen | 54/8 |
| 2,280,853 | 4/1942 | Rody | 54/7 |
| 2,466,147 | 4/1949 | Bergen | 54/6.1 |
| 2,940,238 | 6/1960 | Poole | 54/7 |
| 4,274,245 | 6/1981 | Stewart . | |
| 4,587,797 | 5/1986 | Conrad | 54/8 |

OTHER PUBLICATIONS

Rimples, Riverdale, New York 10471–0061 Catalogue III, 1989.

*Primary Examiner*—Todd E. Manahan
*Attorney, Agent, or Firm*—Cumpston & Shaw

[57] ABSTRACT

A bit for use with domestic riding animals, such as horses, has a mouthpiece including an arcuate portion curved in a plane oriented at between about 15 degrees to 75 degrees, and preferably at an angle of about 45 degrees, with respect to the jaw plane of the animal, and a pair of spaced apart cheekplates connected to the mouthpiece at slotted shank ends thereof. The cheekplates each include a central ring portion positioned along the major axis of the cheekplate having a rein slot; a shaft collinear with the major axis intersecting the ring portion; an integral bridle attachment at an end of the shaft; and an integral curbstrap attachment offset from the shaft intermediate the ring portion and the bridle attachment. The cheekplates are semi-rigidly connected to the mouthpiece by the engagement of the shaft with the slots and retained therein by a bolt and washer assembly such that each cheekplate can freely fit between about −5 degrees to +5 degrees about the major axis of the slot. The bolt and washer assembly provides for releasably connecting the cheekplates to the mouthpiece for replacing the mouthpiece as needed.

12 Claims, 3 Drawing Sheets

HORSE BIT ASSEMBLY INCLUDING AN ANGLED, CONFIGURED MOUTHPIECE AND CHEEKPLATES

BACKGROUND OF THE INVENTION

The present invention relates to bits for driving and/or riding domestic animals such as horses, mules, donkeys, and the like; and more particularly to an improved bit structure including a configured mouthpiece and cheekplates.

There are many varieties of bits for use with animals such as horses, for example; however, they all include two principal components: a mouthpiece and means for attaching a bridle to the bit, variously referred to as cheek pieces or cheekplates. Bits may also include means for attaching reins and a curb chain to the cheekplates. In general, the experience of the driver or rider, and the type of activity, will dictate the particular type or design of bit used.

The mouthpiece of the bit may consist of a solid bar that is either straight and lies in the jaw plane of the animal, or curved and arching over the horse's tongue perpendicular to the roof of the mouth. Alternatively, mouthpieces can be singly or doubly jointed at their center with the apex or center portion of the mouthpiece directed towards the roof of the horse's mouth. The particular mouthpiece used depends upon the amount of control desired by the driver/rider, and the animal's temperament.

Cheekplates are typically either rigidly attached to the shanks of the mouthpiece so as to each lie fixed in a vertical plane normal to a common axis passing through the shanks of the mouthpiece, like wheels on an axle; or less rigidly attached to allow the cheekplates to fold against the mouthpiece until they are nearly coplanar with the jaw plane of the animal.

Conventional bits such as those described above have a number of disadvantages. The fit of the mouthpiece as well as its shape and orientation during use affect the control of the horse and also influence the stance, posture, pelvic alignment, and poll flexion of the animal. Mouthpieces lying flat in the jaw plane, or curved in a plane perpendicular to the jaw plane (towards the roof of the mouth), do not encourage proper poll flexion, and may injure the animal when an inexperienced driver/rider over controls a particular style bit.

Cheekplates that are either rigidly or freely affixed to a mouthpiece, as described above, are also disadvantageous. Rigidly affixed cheekplates combined with a jointed mouthpiece can result in discomfort and injury to the animal because they readily permit over control; while cheekplates that are free to fold against the mouthpiece have a tendency to catch and pinch the edges of the horse's mouth resulting in animal discomfort and possible injury or infection, and potential danger to the driver, rider or trainer.

Furthermore, the reins are typically attached to substantially circular ring portions of the cheekplates which allow a considerable amount of rein slippage around the circumference of each ring. This slippage causes misdirection of the force vectors from the reins to the mouthpiece, sending ambiguous control signals to the animal.

Finally, curb chains employing open hooks at their ends for typical attachment to the bridle ring of the bit are prone to slippage and, ultimately, improperly fitted bits. These conditions can lead to mouth, head, neck, and pelvis problems, affecting the general comfort and control of the animal.

Consequently, there is a need for a bit and the separate component parts thereof, that is comfortable to an animal while providing the desired control; that encourages proper musculoskeletal posturing; that consistently communicates the control signals intended by the rider; and that remains properly fitted to the animal during use.

Accordingly, it is an object of the present invention to provide an improved bit for driving and riding domestic animals such as horses and the like.

Another object of the invention is to provide a bit including a replaceable mouthpiece with a shape and operative orientation which encourages proper poll flexion.

It is another object of the invention to provide a bit including cheekplates which encourage proper movement of the animal's back and pelvis during use.

It is another object of the invention to provide a bit including cheekplates having rein attachments that prevent slippage of the reins and permit clear control signal transmission to the mouthpiece.

It is a still further object of the invention to provide a bit including cheekplates having curbstrap attachment points that maintain the proper fit of the bit when a curbstrap is used.

Another object of the invention is to provide bit components including a replaceable mouthpiece and cheekplates which contribute to a bit having the objects described above.

Other objects, advantages, and features of the present invention will be apparent from the following detailed description of the invention when read in conjunction with the accompanying drawings.

SUMMARY OF THE INVENTION

The present invention relates to a bit for use in driving and riding domestic animals such as horses, donkeys, mules, and the like, and includes a configured mouthpiece for comfortable disposition over the animal's tongue, having bored and threaded, slotted, terminal shanks providing means for releasably attaching the mouthpiece to the bit, and an intermediate arcuate portion curved in a first plane; and, first and second spaced apart cheekplates. Each cheekplate has a major axis and includes a shaft that is collinear with the major axis. The shaft has a central discontinuity for a through-passing bolt to engage the mouthpiece shank bore and retain the cheekplate in the mouthpiece slot. The curve of the mouthpiece lies in a plane oriented at between about 15 degrees to 75 degrees, and preferably at an angle of about 45 degrees, with respect to a common plane passing through the cheekplate major axes, to encourage proper poll flexion. In use, the mouthpiece curve lies in a plane that intersects the jaw plane of the animal at an angle from between about 15 degrees to 75 degrees, and preferably at an angle of about 45 degrees, in a direction towards the animal's head. Movement of the animal's back and pelvis is also encouraged by use of the bit of the invention because the shank slots allow each cheekplate to tilt from between about −5 degrees to +5 degrees with respect to a plane perpendicular to a common axis passing through the shanks of the mouthpiece, and normal to the jaw plane of the animal.

The cheekplates further contain a central ring portion centered along the shaft that includes a rein slot formed between a circumferential arc section of the ring portion and a bar located inside the ring portion that intersects the circumferential arc section and that is parallel to the shaft. A slotted rein attachment reduces transmission of spurious control signals caused by rein slippage on ring-shaped attachment points. Each cheekplate also includes a bridle attachment located at an end of the shaft. Furthermore, an integral curbstrap attachment is offset from the shaft and is located intermediate the ring portion and the bridle attachment. The offset location permits the curbstrap to be positioned for maximum effectiveness.

In accordance with another aspect of the invention a replaceable mouthpiece comprises an arcuate portion including bored and threaded, slotted, terminal shanks. Each slot has a longitudinal major axis. The arc of the mouthpiece lies in a plane oriented between about 15 degrees to 75 degrees, and preferably at an angle of about 45 degrees, with respect to a common plane containing the major axes. The mouthpiece preferably comprises a bronze mouthpiece.

In accordance with a further aspect of the invention a cheekplate has a major axis and includes a shaft having a central discontinuity for a bolt or other cheekplate retaining means to pass through, collinear with the major axis; a central ring portion including a rein slot formed between a circumferential arc section of the ring portion and a bar running parallel to the shaft and intersecting the circumferential arc section; an integral bridle attachment positioned at an end of the shaft; and, an integral curbstrap attachment offset from the shaft and located intermediate the ring portion and the bridle attachment.

DESCRIPTION OF THE PREFERRED EMBODIMENTS

Figure 1:
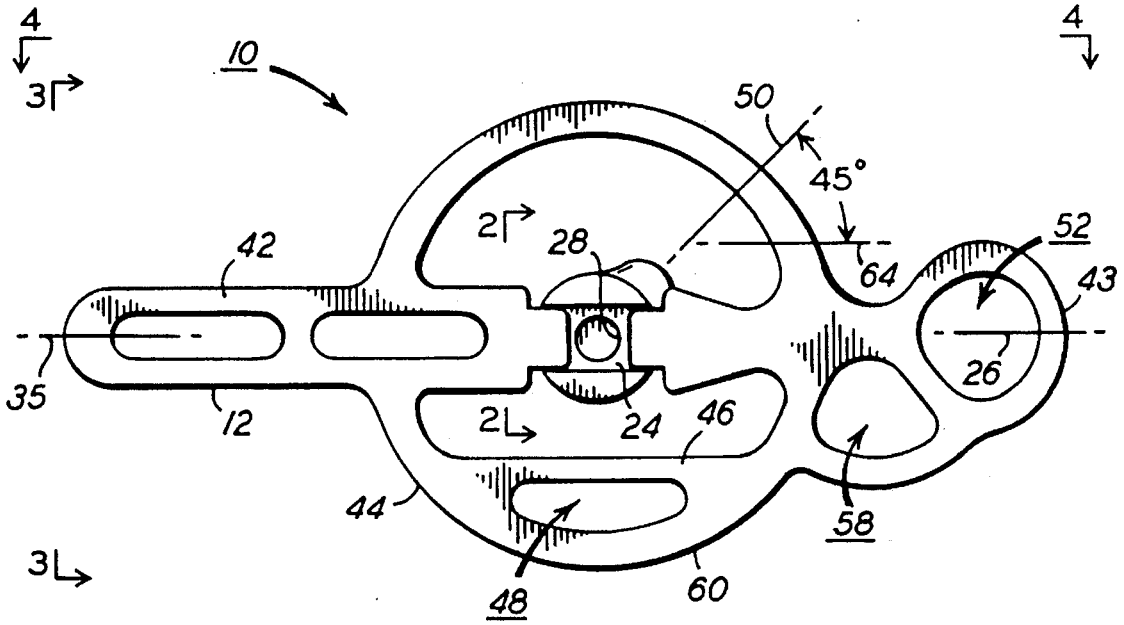
FIG. 1 is a right side view of the preferred embodiment of the cheekplate and mouthpiece of the invention showing the 45 degree orientation of the plane of curvature of the mouthpiece in relation to the cheekplates.
Figure 2:
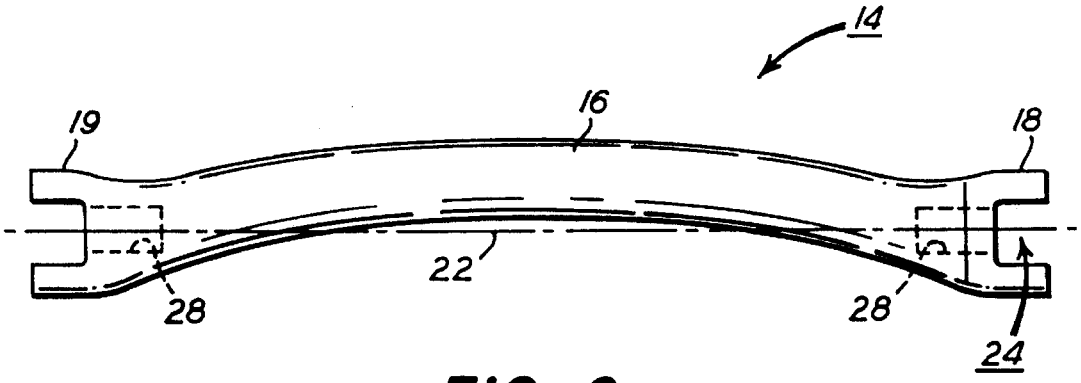
FIG. 2 is a front view of the mouthpiece of the invention along lines 2—2 of FIG. 1.
Figure 7:
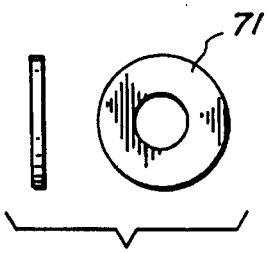
FIG. 7 shows the washer of the cheekplate retaining assembly.
Figure 6:
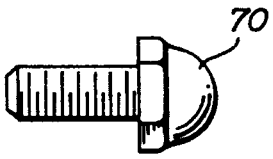
FIG. 6 is a side view of the bolt of the cheekplate retaining assembly.
Figure 3:
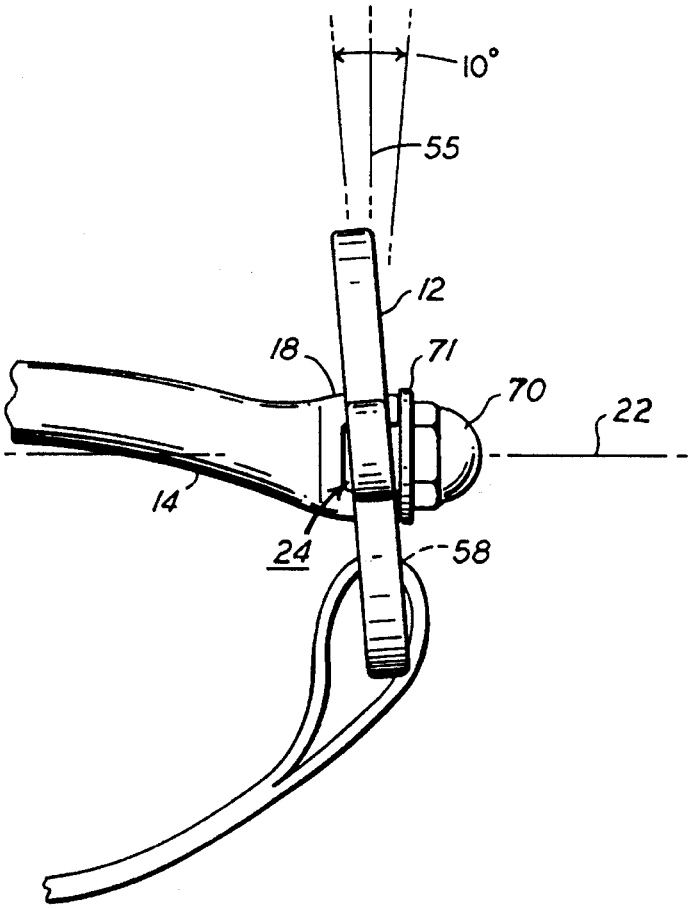
FIG. 3 is a partial front view of the invention through lines 3—3 of FIG. 1 showing the ±5 degree tilt of the cheekplate with respect to the vertical orientation of the cheekplate.

Referring to the drawings in which like reference numerals refer to like parts throughout the several views, FIG. 1–7 show a bit 10 in accordance with the present invention. The bit 10 includes first and second cheekplates 12 and 13, and mouthpiece 14, shown in plan view in FIG. 4. FIG. 2 shows the mouthpiece 14 which comprises arcuate portion 16 having first and second terminal shanks 18 and 19. A longitudinal axis 22 is common to shanks 18, 19. Each shank has a slot 24 having a longitudinal major axis 26, depicted in FIG. 1, for engaging a cheekplate, and a threaded bore 28 for receiving a bolt 70 and washer 71, or other cheekplate retaining means. The threaded bore 28 permits the mouthpiece 14 to be releasably connected to the cheekplate resulting in a replaceable mouthpiece as needed. FIG. 3 shows the cheekplate as it is semi-rigidly connected to the mouthpiece and allowed to tilt by a limited amount when the cheekplate is retained by the bolt and washer, as will be more clearly described in connection with the cheekplates below. Referring again to FIG. 1, the arcuate portion 16 of mouthpiece 14 is curved in a first plane 50, the plane being oriented between about 15 degrees and 75 degrees, and preferably at an angle of about 45 degrees, with respect to a common plane 64 (shown raised from and parallel to its actual position for clarity) containing the major axes 35 of cheekplates 12 and 13, in a direction towards the animal's head (not shown).

Figure 5:
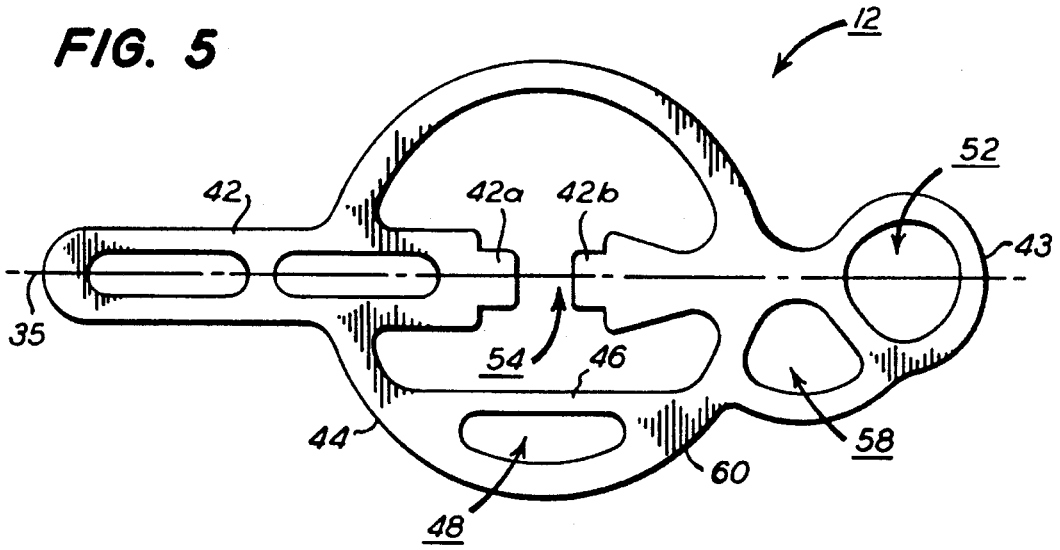
FIG. 5 is a side view of the cheekplate of the invention.
Figure 4:
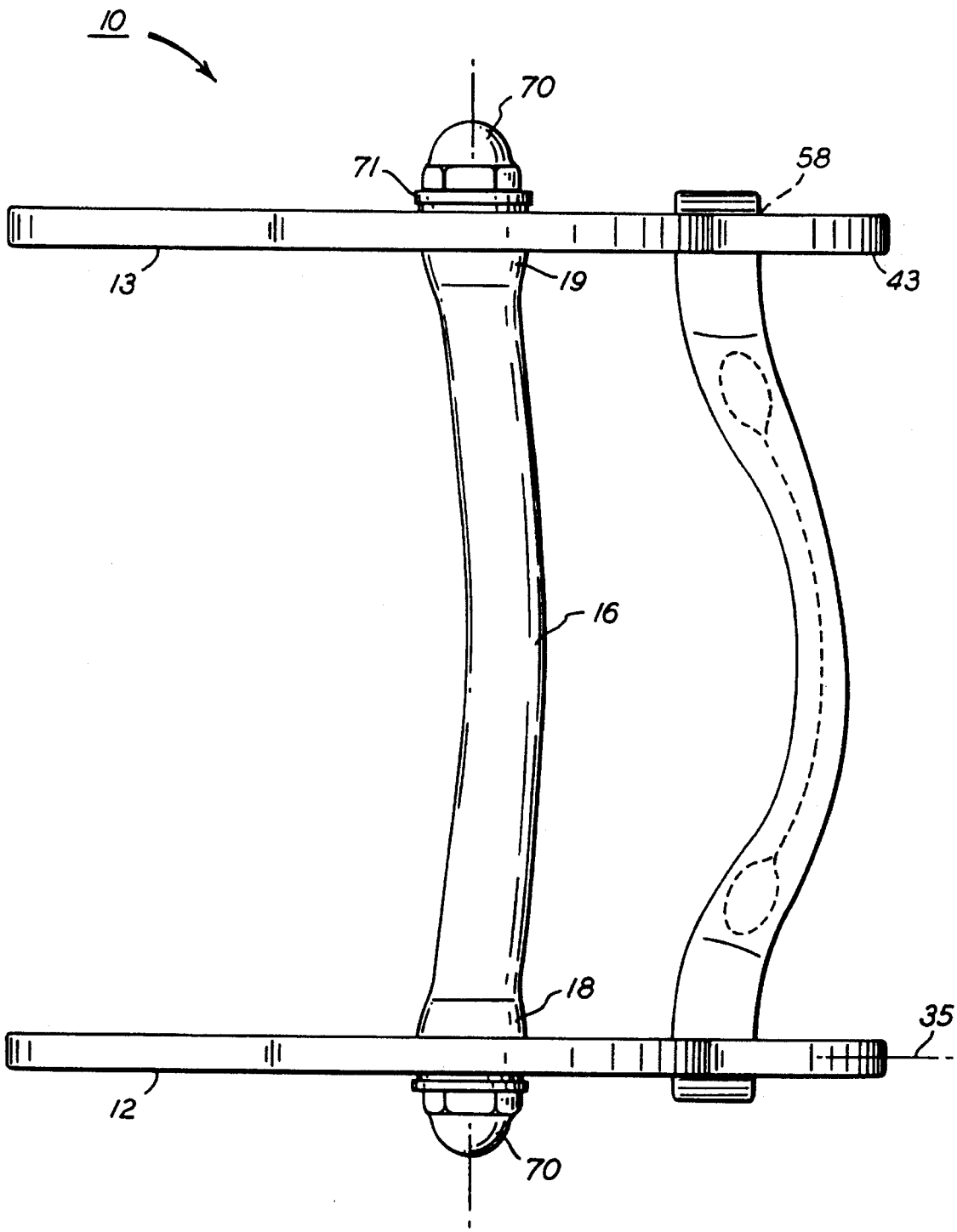
FIG. 4 is a plan view of the invention through lines 4—4 of FIG. 1.

FIG. 5 shows a representative cheekplate 12; the cheekplates 12 and 13 being identical in all respects. Each cheekplate has a major axis 35 and includes a shaft 42 collinear with major axis 35. The shaft 42 has a central discontinuity at 54 which serves the dual purposes of providing shaft ends 42*a*, 42*b* for engaging in slot 24 of the mouthpiece shank; and, providing space for a bolt or other cheekplate retaining means to pass through the cheekplate and engage bore 28. The larger size of slot 24 in relation to the shaft ends 42*a*, 42*b*, shown diagrammatically in FIGS. 1 and 3, permits the cheekplate to freely tilt about an axis of rotation collinear with slot major axis 26 between about −5 degrees and +5 degrees with respect to a plane normal to the shank; i.e., with respect to the vertical orientation of the cheekplate as denoted by line 55 in FIG. 3. Each cheekplate further includes a central ring portion 44 having its diametral center along the shaft 42. Ring portion 44 contains a rein slot 48 located between a circumferential arc 60 of the ring portion and a bar 46 that is oriented parallel to the shaft 42 and which intersects the circumferential arc 60. A bridle attachment 52 is located at an end 43 of shaft 42. Each cheekplate further includes a curbstrap attachment 58 in the form of a closed loop that is offset below shaft 42 and positioned between ring portion 44 and bridle attachment 52.

In the preferred embodiment of the invention the mouthpiece 14 is bronze. The cheekplates are preferably die cast in brass; however, other suitable materials include bronze and stainless steel, for example.

It will be appreciated by those skilled in the art that certain modifications and variations to the invention may be made without affecting the scope of the invention as set forth in the appended claims.

What is claimed is:

1. A cheekplate for a bit in which the cheekplate has a major axis, comprising:

a shaft co-linear with the major axis including a central discontinuity;

an integral central ring portion having a diametral center on the shaft including a rein slot located between a circumferential arc section of the ring portion and a bar intersecting the circumferential arc section of the ring portion, the bar being parallel to said shaft;

an integral bridle attachment depending from an end of the shaft; and an integral curbstrap attachment offset from the major axis and intermediate the ring portion and the bridle attachment.

2. A bit for applying forces to the mouth of a domestic animal having a lower jaw with a given width and substantially defining a jaw plane, the bit comprising:

a mouthpiece having a first and a second end each of which includes a slot having a major longitudinal axis, in which the axes lie in a common plane, and a threaded bore, whereby the mouthpiece is replaceable in the bit, and having a sufficient length to extend substantially across the width of the jaw, the mouthpiece including an arcuate portion intermediate the first and second ends, the arcuate portion having a curvature oriented in a mouthpiece plane, wherein the mouthpiece plane intersects the common plane containing the longitudinal axes of the slots at an angle of between about 15 degrees and 75 degrees; and a first and a second cheekplate connected to the first and second end, respectively, of the mouthpiece, in which each cheekplate has a major axis substantially coplanar with the jaw plane and further in which each cheekplate comprises a ring portion diametrally centered along the cheekplate major axis; and an integral shaft collinear with the cheekplate major axis, whereby the shaft intersects the ring potion, and further in which each ring portion includes a rein slot formed between a circumferential arc section of the ring portion and a bar positioned parallel to the shaft and intersecting the circumferential ring portion.

3. The bit of claim 2 in which each cheekplate comprises an integral bridle attachment at an end of the shaft.

4. The bit of claim 2 in which each cheekplate comprises an integral curbstrap attachment offset from the shaft.

5. A bit comprising:

a mouthpiece including an intermediate arcuate portion curved in a first plane and first and second terminal shanks; and first and second spaced apart cheekplates connected to the first and second shanks, respectively, in which each cheekplate has a major axis, further in which the arcuate portion lies in a plane oriented at between about 15 degrees to 75 degrees with respect to a common plane passing through the major axes of the cheekplates, in which each cheekplate further comprises a shaft collinear with the major axis; a central ring portion having a diametral center on the shaft including a rein slot located between a circumferential arc section of the ring portion and a bar intersecting the circumferential arc section of the ring portion, the bar being parallel to said shaft.

6. The bit of claim 5 further comprising an integral bridle attachment depending from an end of the shaft.

7. The bit of claim 5 further comprising an integral curbstrap attachment offset from the major axis.

8. The bit of claim 7 which the integral curbstrap attachment is intermediate the ring portion and the bridle attachment.

9. A bit comprising:

a mouthpiece having a first and a second end including a common axis running through the ends; and a first and a second cheekplate semi-rigidly connected to the first and second end, respectively, of the mouthpiece, in which each cheekplate lies in a plane that can freely rotate between about −10 degrees and +10 degrees with respect to a plane normal to the common axis of the mouthpiece, in which the cheekplate has a major axis, the cheekplate further comprising a shaft collinear with the major axis; and a central ring portion diametrally centered along the shaft, the ring portion including a rein slot formed between a circumferential arc section of the ring portion and a bar intersecting the circumferential arc section of the ring portion, the bar being parallel to said shaft.

10. The bit of claim 9 in which the cheekplate further comprises an integral bridle attachment depending from an end of the shaft.

11. The bit of claim 9 in which the cheekplate further comprises an integral curbstrap attachment offset from the shaft.

12. The bit of claim 11 in which the integral curbstrap attachment is intermediate the ring portion and the bridle attachment.

* * * * *